US009810238B2

(12) United States Patent
Annati et al.

(10) Patent No.: US 9,810,238 B2
(45) Date of Patent: Nov. 7, 2017

(54) TURBOCHARGER WITH TURBINE SHROUD

(71) Applicant: Caterpillar Inc., Peoria, IL (US)

(72) Inventors: Richard E. Annati, Lafayette, IN (US); Jeffrey W. McCormack, Fishers, IN (US); Matthew J. Frick, Novi, MI (US)

(73) Assignee: Caterpillar Inc., Peoria, IL (US)

( * ) Notice: Subject to any disclaimer, the term of this patent is extended or adjusted under 35 U.S.C. 154(b) by 191 days.

(21) Appl. No.: 14/642,634

(22) Filed: Mar. 9, 2015

(65) Prior Publication Data

US 2016/0265379 A1 Sep. 15, 2016

(51) Int. Cl.
*F04D 29/42* (2006.01)
*F01D 9/04* (2006.01)

(52) U.S. Cl.
CPC ..... *F04D 29/4226* (2013.01); *F01D 9/045* (2013.01); *F05D 2220/40* (2013.01)

(58) Field of Classification Search
CPC ..... F04D 29/4226; F01D 9/045; F01D 5/141; F01D 11/006; F01D 11/008; F01D 11/18; F05D 2220/40
See application file for complete search history.

(56) References Cited

U.S. PATENT DOCUMENTS 2,372,880 A * 4/1945 Browne ..... F04D 29/444 415/207
3,067,981 A * 12/1962 Swatman ..... F01D 25/16 415/138

(Continued)

FOREIGN PATENT DOCUMENTS

DE 10 2010 064 047 A1 6/2012
EP 2 592 230 B1 5/2014

(Continued)

OTHER PUBLICATIONS

U.S. Appl. No. 14/642,033 entitled "Turbocharger Turbine Containment Structure" filed Mar. 9, 2015.

(Continued)

*Primary Examiner* — Nathaniel Wiehe
*Assistant Examiner* — Elton Wong
(74) *Attorney, Agent, or Firm* — Finnegan, Henderson, Farabow, Garrett & Dunner LLP

(57) ABSTRACT

A turbine assembly includes a turbine housing and a turbine wheel disposed within the turbine housing. The turbine wheel includes a rotational axis and a plurality of blades. The turbine assembly includes a turbine shroud disposed between the turbine housing and the turbine wheel along a radial direction. The turbine shroud is separate from the turbine housing. The turbine shroud includes an annular portion extending generally in an axial direction with respect to the rotational axis and a plate portion intersecting the annular portion to form a convex curved surface. At least a portion of the blades is disposed in at least a portion of the annular portion. Each blade includes a leading edge and a tip portion. Each leading edge is angled with respect to the rotational axis, and each tip portion forms a concave portion that curves around the curved surface of the turbine shroud.

14 Claims, 6 Drawing Sheets

(56) References Cited

U.S. PATENT DOCUMENTS 4,907,952 A * 3/1990 Inoue ..... F01D 17/165 417/407
5,253,985 A 10/1993 Ruetz
5,299,909 A 4/1994 Wulf
5,460,003 A * 10/1995 Nenov ..... F01D 9/045 415/186
5,465,482 A 11/1995 Elvekjaer et al.
5,526,640 A 6/1996 Brooks et al.
5,964,574 A 10/1999 Meier et al.
6,045,266 A 4/2000 Mitsubori et al.
6,120,246 A 9/2000 Auger et al.
6,168,375 B1 1/2001 LaRue et al.
6,220,234 B1 4/2001 Baker et al.
6,264,429 B1 7/2001 Koeller et al.
6,368,077 B1 4/2002 Meyerkord et al.
6,371,238 B1 4/2002 Svihla
6,478,553 B1 11/2002 Panos et al.
6,499,884 B1 12/2002 Svihla et al.
6,540,480 B2 4/2003 Nikpour
6,629,556 B2 10/2003 Decker et al.
6,663,347 B2 12/2003 Decker et al.
6,669,372 B1 12/2003 Martin
6,709,232 B1 3/2004 Vogiatzis
6,733,236 B2 5/2004 Sumser et al.
6,742,989 B2 6/2004 Osako et al.
6,754,954 B1 6/2004 Decker
6,767,185 B2 7/2004 Martin et al.
6,874,998 B2 4/2005 Roby
6,877,901 B2 4/2005 Wollenweber
6,904,949 B2 6/2005 Decker et al.
6,928,816 B2 8/2005 Leavesley
6,942,460 B2 9/2005 Osako et al.
6,968,702 B2 11/2005 Child et al.
6,979,172 B1 12/2005 Mackenzie
6,979,183 B2 12/2005 Baumann
6,994,526 B2 2/2006 Furman et al.
7,001,143 B2 2/2006 Vogiatzis
7,001,155 B2 2/2006 Cabrales et al.
7,008,182 B2 3/2006 Kopp et al.
7,010,915 B2 3/2006 Stilgenbauer
7,040,867 B2 5/2006 Louthan et al.
7,052,241 B2 5/2006 Decker
7,063,508 B2 6/2006 Higashimori et al.
7,066,919 B1 6/2006 Sauerland et al.
7,086,842 B2 8/2006 Wild
7,097,411 B2 8/2006 Smoke et al.
7,104,693 B2 9/2006 Mavrosakis
7,118,335 B2 10/2006 Vacarezza et al.
7,147,433 B2 12/2006 Ghizawi
7,191,519 B2 3/2007 Roby
7,204,671 B2 4/2007 Dellmann
7,214,037 B2 5/2007 Mavrosakis
7,232,258 B2 6/2007 Garcia
7,241,416 B2 7/2007 Sweetland
7,329,048 B2 2/2008 Klusman et al.
7,344,362 B2 3/2008 Kopp et al.
7,384,236 B2 6/2008 Meier et al.
7,401,980 B2 7/2008 Krauss et al.
7,419,304 B2 9/2008 Mavrosakis
7,445,428 B2 * 11/2008 Baar ..... F01D 17/165 415/164
7,461,507 B2 12/2008 Arnold et al.
7,461,979 B2 12/2008 Mavrosakis
7,478,532 B2 1/2009 Martin et al.
7,484,932 B2 2/2009 Aguilar
7,517,154 B2 4/2009 McKeirnan, Jr.
7,568,883 B2 8/2009 Arnold et al.
7,600,969 B2 10/2009 Frankenstein et al.
7,631,497 B2 12/2009 Panek
7,677,041 B2 3/2010 Woollenweber
7,686,586 B2 3/2010 Nikpour
7,722,336 B2 5/2010 Vaccarezza et al.
7,766,550 B2 8/2010 Larue
7,771,162 B2 8/2010 Castan
7,771,170 B2 8/2010 Seiler
7,793,494 B2 9/2010 Wirth et al.
7,797,936 B2 9/2010 Hayashi et al.
7,798,770 B2 9/2010 Sumser et al.
7,837,448 B2 11/2010 Shimizu et al.
7,845,900 B2 12/2010 Roduner et al.
7,874,136 B2 1/2011 Heyerman
7,878,758 B2 2/2011 Allen et al.
7,918,215 B2 4/2011 Martin et al.
7,946,809 B2 5/2011 Meier et al.
7,987,599 B2 8/2011 Mavrosakis
8,011,885 B2 9/2011 Purdey
8,016,554 B2 9/2011 Ward
8,118,570 B2 2/2012 Meacham et al.
8,157,516 B2 4/2012 Chen et al.
8,157,543 B2 4/2012 Shimizu
8,162,602 B2 4/2012 Caucheteux et al.
8,162,604 B2 4/2012 Kühnel et al.
8,166,746 B2 5/2012 Heyerman
8,181,632 B2 5/2012 Ueno et al.
8,186,886 B2 5/2012 McKeirnan, Jr.
8,226,296 B2 7/2012 Larue
8,234,867 B2 8/2012 Palazzolo et al.
8,240,921 B2 8/2012 Böning et al.
8,241,006 B2 8/2012 Renett
8,322,978 B2 12/2012 Dilovski et al.
8,328,509 B2 12/2012 Gee et al.
8,328,535 B2 12/2012 Anschel et al.
8,339,122 B2 12/2012 Cox et al.
8,348,595 B2 1/2013 Koch et al.
8,353,666 B2 1/2013 Masson et al.
8,360,730 B2 1/2013 Chen et al.
8,372,335 B2 2/2013 Claude et al.
8,376,721 B2 2/2013 Thayer et al.
8,398,363 B2 3/2013 Mundinger et al.
8,418,458 B2 4/2013 Williams et al.
8,419,350 B2 4/2013 Just
8,449,190 B2 5/2013 Larue
8,454,242 B2 6/2013 Mavrosakis
8,464,528 B2 6/2013 Sausse et al.
8,464,777 B2 6/2013 Zhu et al.
8,465,261 B2 6/2013 Holzschuh
8,496,452 B2 7/2013 Marsal et al.
8,517,665 B2 8/2013 Lugo et al.
8,517,679 B2 8/2013 Schlienger et al.
8,545,172 B2 * 10/2013 Severin ..... F01D 25/145 415/164
8,550,775 B2 * 10/2013 Chen ..... F04D 29/162 415/119
8,568,092 B2 10/2013 Matsuyama
8,572,963 B2 11/2013 Cuniberti et al.
8,602,655 B2 12/2013 Tabata
8,621,863 B2 1/2014 Krätschrner et al.
8,622,691 B2 1/2014 Eguchi et al.
8,628,247 B2 1/2014 Uesugi
8,636,413 B2 1/2014 Fiedler et al.
8,641,380 B2 2/2014 McKenzie
8,641,382 B2 2/2014 Weber et al.
8,668,432 B2 3/2014 Sebald et al.
8,696,316 B2 4/2014 Decker et al.
8,702,394 B2 4/2014 Decker et al.
8,727,716 B2 5/2014 Clements et al.
8,734,130 B2 5/2014 Meacham et al.
8,736,393 B2 5/2014 Herault et al.
8,740,465 B2 6/2014 McKeirnan, Jr.
8,763,393 B2 7/2014 Severin et al.
8,764,296 B2 7/2014 Omori
8,764,376 B2 7/2014 Lei et al.
8,764,388 B2 7/2014 Roberts et al.
8,790,066 B2 7/2014 Gutknecht
8,790,574 B2 7/2014 Toda et al.
8,794,905 B2 8/2014 Matsuyama
8,807,840 B2 8/2014 House et al.
8,814,538 B2 8/2014 House et al.
8,834,111 B2 9/2014 Holzschuh
8,845,271 B2 9/2014 Woollenweber et al.
8,961,128 B2 2/2015 Mavrosakis et al.
2004/0109760 A1 6/2004 Jones
2007/0036646 A1 * 2/2007 Nguyen ..... F04D 29/4206 415/208.3

(56) References Cited

U.S. PATENT DOCUMENTS

| | | | | |
|---|---|---|---|---|
| 2010/0316494 | A1 | 12/2010 | Gruβmann et al. | |
| 2011/0120124 | A1 | 5/2011 | Czerwinski et al. | |
| 2011/0182722 | A1* | 7/2011 | Matsuyama | F01D 11/005 415/174.2 |
| 2011/0206500 | A1* | 8/2011 | Nagao | F01D 5/141 415/148 |
| 2012/0082539 | A1* | 4/2012 | Mohiki | F01D 17/165 415/159 |
| 2012/0269636 | A1* | 10/2012 | Xu | F01D 5/141 416/185 |
| 2013/0309072 | A1 | 11/2013 | Marsal et al. | |
| 2014/0212277 | A1* | 7/2014 | Uesugi | F01D 17/145 415/151 |
| 2014/0358363 | A1 | 12/2014 | Mavrosakis et al. | |
| 2015/0056067 | A1* | 2/2015 | Segawa | F01D 11/005 415/167 |
| 2015/0086396 | A1* | 3/2015 | Nasir | F01D 5/141 417/407 |
| 2015/0252689 | A1* | 9/2015 | Burmester | F02C 6/12 415/177 |

FOREIGN PATENT DOCUMENTS

| | | | |
|---|---|---|---|
| JP | 2011-163239 | A | 8/2011 |
| JP | 2011-247189 | A | 12/2011 |

OTHER PUBLICATIONS

U.S. Appl. No. 14/642,133 entitled "Turbocharger Turbine Assembly" filed Mar. 9, 2015.
U.S. Appl. No. 14/642,143 entitled "Turbocharger Turbine Nozzle and Containment Structure" filed Mar. 9, 2015.

* cited by examiner

TURBOCHARGER WITH TURBINE SHROUD

TECHNICAL FIELD

The present disclosure relates generally to a turbocharger, and more particularly, to a turbocharger with a turbine shroud.

BACKGROUND

Internal combustion engines, for example, diesel engines, gasoline engines, or natural gas engines employ turbochargers to deliver compressed air for combustion in the engine. A turbocharger compresses air flowing into the engine, helping to force more air into the combustion chambers of the engine. The increased supply of air allows increased fuel combustion in the combustion chambers of the engine, resulting in increased power output from the engine.

A typical turbocharger includes a shaft, a turbine wheel attached to one end of the shaft, a compressor impeller connected to the other end of the shaft, and bearings to support the shaft. Often a turbine housing surrounds the turbine wheel and a separate compressor housing surrounds the compressor impeller. In addition, the turbocharger may include a bearing housing that surrounds the bearings and includes features that help prevent leakage of bearing lubrication oil into the turbine housing or the compressor housing. The turbine housing, the compressor housing, and the bearing housing are attached to each other via fasteners or other clamping mechanisms.

Hot exhaust from the engine flows through the turbine housing and expands over the turbine wheel, rotating the turbine wheel and the shaft connected to the turbine wheel. The shaft in turn rotates the compressor impeller. Relatively cool air from the ambient flows through the compressor housing where the compressor impeller compresses the air and drives the compressed air into the combustion chambers of the engine.

Because the exhaust from the engine is significantly hotter than the ambient air, the turbine wheel and the turbine housing can experience temperatures significantly higher than the other components of the turbocharger, such as the bearing housing and the compressor housing. Also, the turbine wheel may have a relatively smaller mass and may be symmetric, whereas the turbine housing may have a relatively larger mass and may be asymmetric. As a result, the turbine housing may increase in temperature more slowly than the turbine wheel, thereby resulting in thermal lag compared to the turbine wheel. Also, both the turbine housing and the turbine wheel may experience thermal expansion, but, because the turbine housing may be asymmetric, the turbine housing may expand asymmetrically. Asymmetric expansion may cause a tip clearance between the turbine wheel and the turbine housing to vary around the turbine wheel so that there may be relatively larger tip clearances in some locations around the turbine wheel, which may reduce the efficiency of the turbocharger.

One attempt to address some of the problems described above is disclosed in U.S. Pat. No. 8,322,978 issued to Dilovski et al. on Dec. 4, 2012 ("the '978 patent"). In particular, the '978 patent discloses a turbocharger including a guide vane cage clamped between a turbine housing and a bearing housing of the turbocharger without fixedly connecting the guide vane cage to either one of the two housings. The guide vane cage may be directly exposed to hot exhaust gases and may be subject to thermal expansion. An axial gap may be formed between the guide vane cage and the turbine housing so that the hot exhaust gas may flow around the guide vane cage, which may allow the guide vane cage to be heated generally uniformly, which may reduce the temperature gradient in the guide vane cage.

Although the turbocharger disclosed in the '978 patent attempts to reduce the temperature gradient in the guide vane cage surrounding the turbine wheel, the disclosed turbocharger may still be less than optimal. For example, the geometry of the turbine wheel and the guide vane cage may not provide tip clearances that are sufficiently small enough to achieve efficient turbocharger performance. Also, the clamping of the guide vane cage between the turbine housing and the bearing housing may not sufficiently isolate the guide vane cage from the turbine housing and may not allow the guide vane cage to respond fast enough to temperature changes, which may cause the blades of the turbine wheel to expand and rub against the guide vane cage.

The turbocharger of the present disclosure solves one or more of the problems set forth above and/or other problems of the prior art.

SUMMARY

In one aspect, the present disclosure is directed to a turbine assembly including a turbine housing and a turbine wheel disposed within the turbine housing. The turbine wheel includes a first end opposite a second end and a rotational axis extending between the first end and the second end. The turbine wheel also includes a plurality of blades. The turbine assembly includes a turbine shroud disposed between the turbine housing and the turbine wheel along a radial direction. The turbine shroud is separate from the turbine housing. The turbine shroud includes an annular portion extending generally in an axial direction with respect to the rotational axis, and at least a portion of the plurality of blades is disposed in at least a portion of the annular portion. The turbine shroud also includes a plate portion intersecting the annular portion to form a convex curved surface. Each of the plurality of blades of the turbine wheel includes a leading edge and a tip portion. Each leading edge is angled with respect to the rotational axis, and each tip portion forms a concave portion that curves around the curved surface of the turbine shroud.

In another aspect, the present disclosure is directed to a turbocharger including a compressor housing having a compressor wheel and a turbine housing having a turbine wheel. The turbine wheel includes a first end opposite a second end and a rotational axis extending between the first end and the second end. The turbocharger also includes a shaft attached at a first end to the compressor wheel and attached at a second end to the turbine wheel. The turbocharger further includes a bearing housing connecting the compressor housing to the turbine housing, and a turbine shroud disposed between the turbine housing and the turbine wheel along a radial direction. The turbine shroud is separate from the turbine housing. The turbocharger also includes a heat shield radially attached to the bearing housing by a plurality of pins extending along the radial direction, and the heat shield is disposed between the bearing housing and the turbine wheel.

In another aspect, the present disclosure is directed to a turbine assembly including a turbine housing and a turbine wheel disposed within the turbine housing. The turbine wheel includes a first end opposite a second end and a rotational axis extending between the first end and the second end. The turbine wheel also includes a plurality of blades. The turbine assembly includes a turbine shroud disposed between the turbine housing and the turbine wheel along a radial direction. The turbine shroud is separate from the turbine housing. The turbine shroud includes an annular portion extending generally in an axial direction with respect to the rotational axis. At least a portion of the plurality of blades is disposed in at least a portion of the annular portion. The turbine shroud also includes a nozzle portion connected to an end of the annular portion. The nozzle portion includes a plurality of nozzle vanes configured to receive a flow of exhaust from the turbine housing. The turbine shroud is formed integrally as a single-piece component.

DETAILED DESCRIPTION

Reference will now be made in detail to exemplary embodiments, which are illustrated in the accompanying drawings. Wherever possible, the same reference numbers will be used throughout the drawings to refer to the same or like parts.

Figure 1:
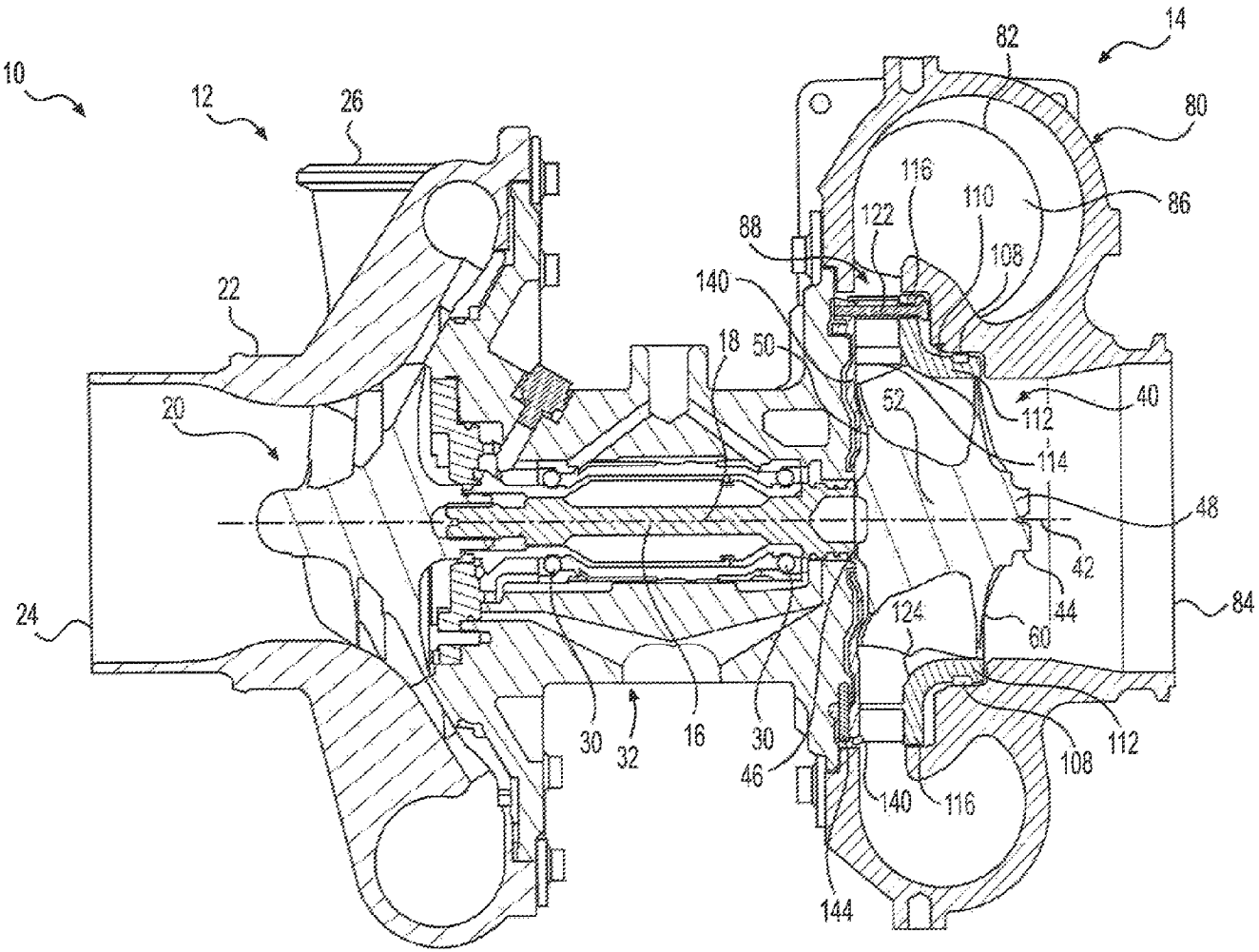
FIG. 1 is a cross-sectional view of a turbocharger including a turbine assembly, according to an exemplary embodiment.

FIG. 1 illustrates an exemplary embodiment of a turbocharger 10. The turbocharger 10 may be used with an engine (not shown) of a machine that performs some type of operation associated with an industry such as railroad, marine, power generation, mining, construction, farming, or another industry known in the art. As shown in FIG. 1, the turbocharger 10 may include a compressor assembly 12 and a turbine assembly 14 connected by a shaft 16.

The compressor assembly 12 may include a fixed geometry compressor impeller or wheel 20 disposed in a compressor housing 22. The compressor wheel 20 and the compressor housing 22 may be disposed around a rotational axis 18 of the shaft 16. The compressor wheel 20 may be attached to the shaft 16 and configured to compress air received at an ambient pressure level before the air enters the engine for combustion. Air may enter the compressor housing 22 via a compressor inlet 24 and exit the compressor housing 22 via a compressor outlet 26. As air moves through the compressor assembly 12, the compressor wheel 20 may force compressed air into the engine.

Bearings 30 may support the shaft 16. The bearings 30 may be disposed in a bearing housing 32. Although FIG. 1 illustrates only two bearings 30, it is contemplated that the turbocharger 10 may include any number of bearings 30.

The turbine assembly 14 may include a turbine wheel 40, a turbine housing 80, a turbine shroud 110, and a heat shield 140. The turbine wheel 40 may be attached to the shaft 16 and may be disposed in the turbine housing 80. The shaft 16 may extend from the compressor housing 22 to the turbine housing 80, and the bearing housing 32 may connect the compressor housing 22 to the turbine housing 80. The turbine wheel 40 and the turbine housing 80 may be disposed around the rotational axis 18 of the shaft 16.

The turbine wheel 40 may rotate about a rotational axis 42, which may be collinear with the rotational axis 18 of the shaft 16. The turbine wheel 40 may include a first end 44, a second end 46 located opposite the first end 44, and the rotational axis 42 may extend between the first end 44 and the second end 46. An end of the shaft 16 may attach to the second end 46 of the turbine wheel 40. The shaft 16 may extend through the bearing housing 32 to connect to the compressor wheel 20 and the turbine wheel 40 at opposite ends of the shaft 16. The turbine wheel 40 may include a nose 48 located at the first end 44, a back wall 50 located at the second end 46, and a hub 52 extending along the rotational axis 42 between the nose 48 and the back wall 50. A plurality of blades 60 of the turbine wheel 40 may be disposed around the hub 52.

Figure 2:
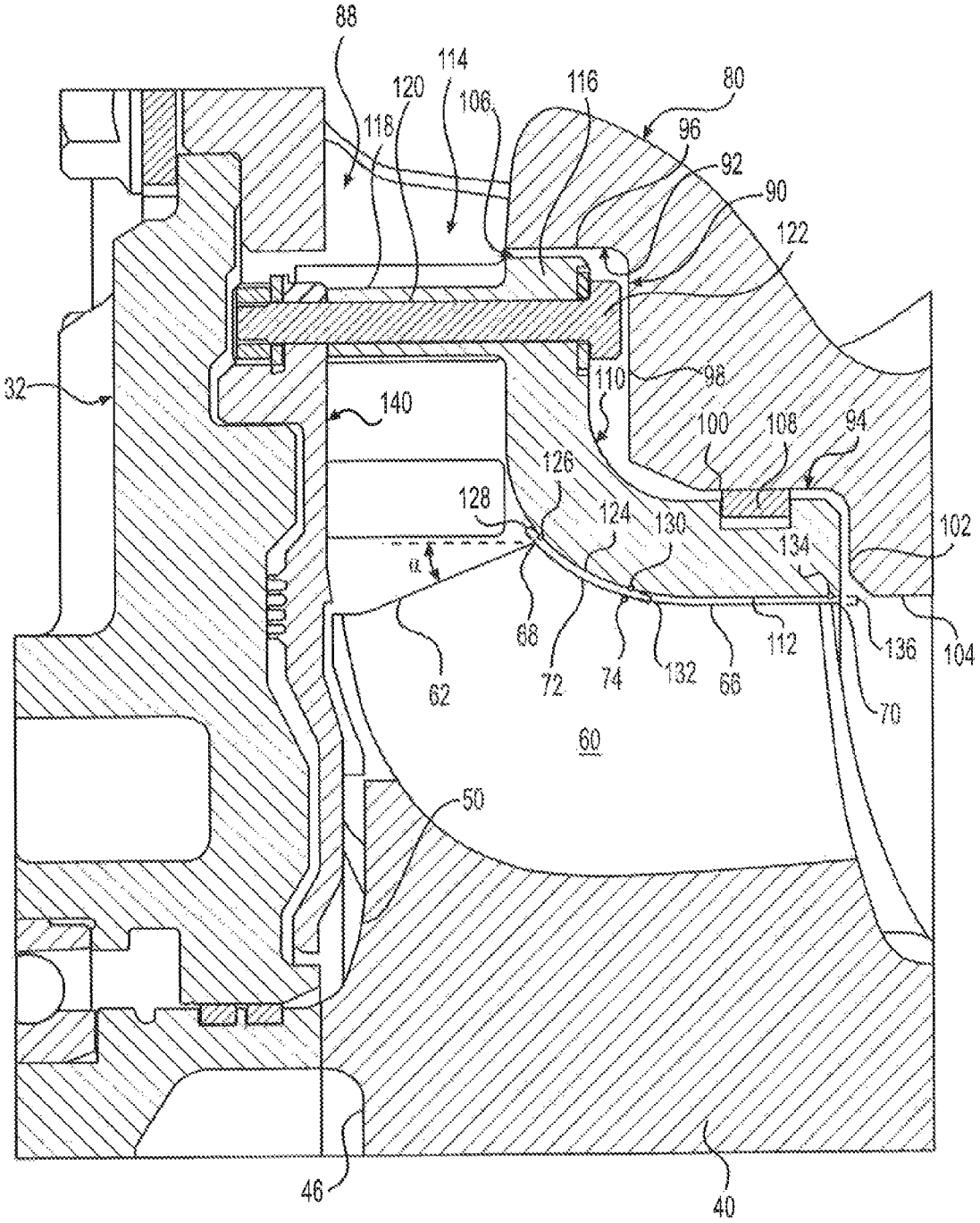
FIG. 2 is a cross-sectional view of a portion of the turbine assembly of FIG. 1.
Figure 3:
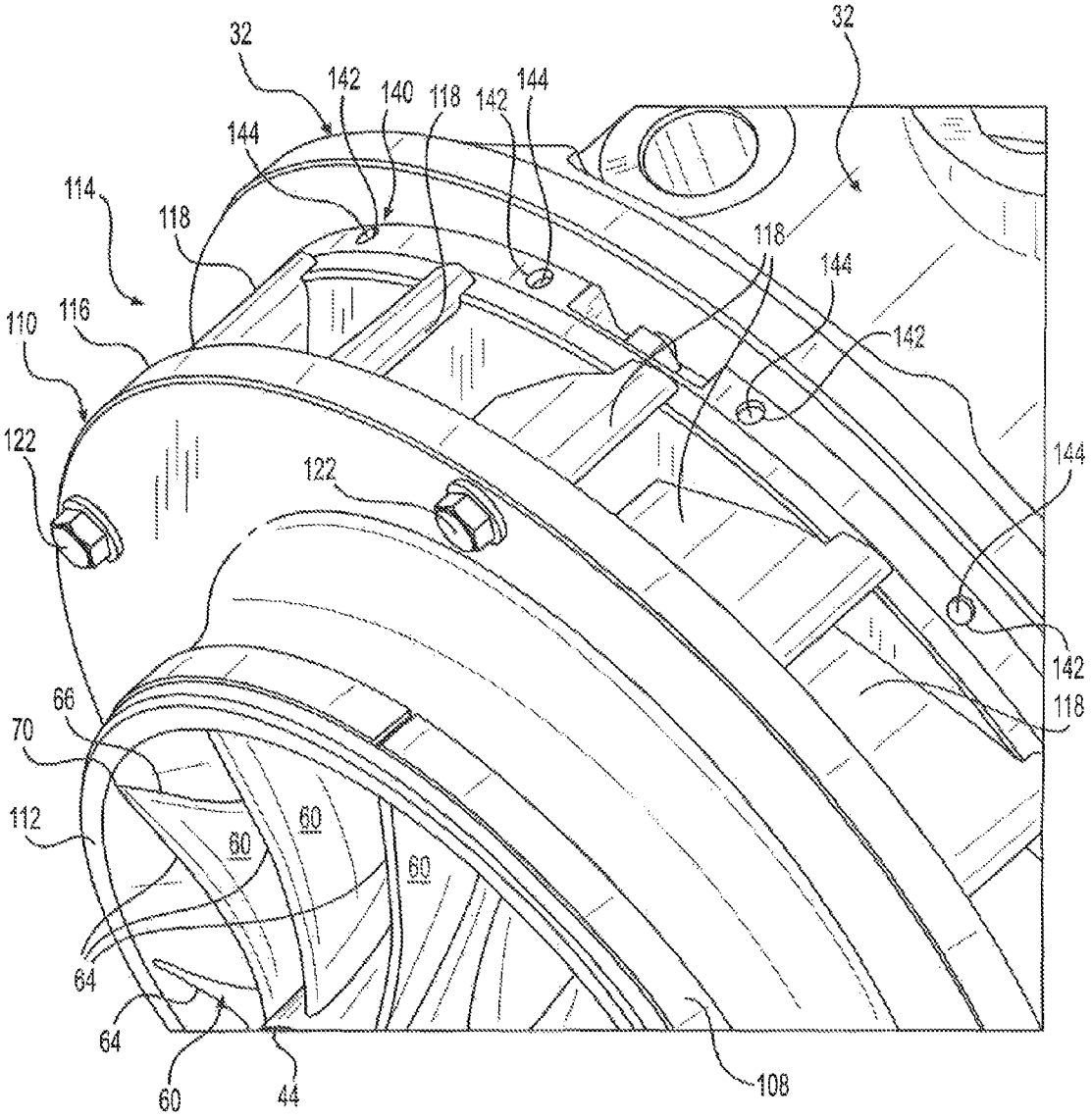
FIG. 3 is a perspective view of a portion of the turbine assembly and bearing housing of the turbocharger of FIG. 1.

FIGS. 2 and 3 illustrate the turbocharger 10 including the bearing housing 32, the turbine wheel 40, the turbine shroud 110, and the heat shield 140. The turbine housing 80 is also shown in FIG. 2, but has been omitted from FIG. 3 for ease of illustration. As shown in FIGS. 2 and 3, each of the blades 60 of the turbine wheel 40 may include a leading edge 62, a trailing edge 64 (FIG. 3), and a tip portion 66 extending between the leading edge 62 and the trailing edge 64. The leading edge 62 and the tip portion 66 may intersect to form a first corner 68. The tip portion 66 and the trailing edge 64 may intersect to form a second corner 70.

In the embodiment shown in FIGS. 1-5, the turbine wheel 40 is a mixed flow turbine wheel, but it is understood that the turbine wheel 40 may be another type of turbine wheel, such as a radial-flow or axial-flow turbine wheel. As shown in FIG. 2, the leading edge 62 may be angled with respect to the rotational axis 42. For example, the leading edge 62 may form an angle $\alpha$ of about 10 degrees to about 40 degrees (e.g., about 30 degrees) with respect to the rotational axis 42 of the turbine wheel 40 (or a plane parallel to the rotational axis 42 of the turbine wheel 40, as shown in FIG. 2). Also, the tip portion 66 may form a concave portion 72 located between the first corner 68 (formed at the intersection between the tip portion 66 and the leading edge 62) and an intermediate point 74 of the tip portion 66. The concave portion 72 may curve around a portion of the turbine shroud 110 as described below.

As shown in FIG. 1, during operation of the turbocharger 10, exhaust gases exiting the engine may enter the turbine housing 80 via a turbine inlet 82 and exit the turbine housing 80 via a turbine outlet 84. As the hot exhaust gases move through the turbine housing 80 and expand against the plurality of blades 60 of the turbine wheel 40, the turbine wheel 40 may rotate the compressor wheel 20 via the shaft 16.

The turbine housing 80 may be asymmetric with respect to the rotational axis 42 of the turbine wheel 40. The turbine housing 80 may include at least one volute 86 that receives a flow of exhaust from the engine via the turbine inlet 82. The turbine housing 80 shown in FIG. 1 includes a single volute 86, but it is understood that the turbine housing 80 may include more than one volute 86. The flow of exhaust may be directed from the volute 86 through a channel 88 in the turbine housing 80. The channel 88 may direct the flow of exhaust to the turbine shroud 110, which may then direct the flow of exhaust to the turbine wheel 40.

The inner surface of the turbine housing 80 may include one or more surfaces that are configured to receive and align with outer surfaces of the turbine shroud 110. For example, the inner surface of the turbine housing 80 may include a stepped surface 90 that corresponds to the outer surface of the turbine shroud 110, as described below. In an embodiment and as shown in FIG. 2, the stepped surface 90 may include a first step 92 and a second step 94 that at least partially align with corresponding stepped features on the turbine shroud 110. The first step 92 may be formed by a first inner annular surface 96 and a first inner radial surface 98, and the second step 94 may be formed by a second inner annular surface 100 and a second inner radial surface 102. The channel 88, through which the exhaust gases may flow from the volute 86 to the turbine shroud 110, may extend through the first inner annular surface 96. The first and second inner annular surfaces 96 and 100 may extend generally along an axial direction (e.g., generally along the rotational axis 42 of the turbine wheel 40), and the first and second inner radial surfaces 98 and 102 may extend generally along a radial direction (e.g., generally along the direction of a radius of the turbine wheel 40). The inner surface of the turbine housing 80 may also include a third inner annular surface 104 that may extend generally along the axial direction, e.g., from the second inner radial surface 102, and may form the turbine outlet 84.

The turbine shroud 110 may be disposed between the turbine housing 80 and the turbine wheel 40 along the radial direction. The turbine shroud 110 may be separate from the turbine housing 80 such that a gap 106 may be formed between at least a portion of the turbine shroud 110 and the turbine housing 80. As shown in FIG. 2, the gap 106 may extend between the outer surfaces of the turbine shroud 110 and inner surfaces of the turbine housing 80, including the first and second inner annular surfaces 96 and 100 and the first and second inner radial surfaces 98 and 102. The gap 106 may be interrupted by a sealing element 108 disposed on the turbine shroud 110. The sealing element 108 may limit or prevent the flow of exhaust from the turbine housing 80 (e.g., from the channel 88) between the turbine housing 80 and the turbine shroud 110. Specifically, the sealing element 108 may limit or prevent the flow of exhaust from bypassing the turbine wheel 40 by flowing through the gap 106 and around the turbine shroud 110.

As shown in FIGS. 1-3, the turbine shroud 110 may include an annular portion 112 extending generally in the axial direction. At least a portion of the turbine wheel 40 may be disposed in the annular portion 112 such that at least a portion of the blades 60 of the turbine wheel 40 may align with at least a portion of the annular portion 112 along the radial direction. The sealing element 108 may be disposed on an outer surface of the annular portion 112, e.g., between the annular portion 112 and the second inner annular surface 100 of the turbine housing 80, as shown in FIG. 2. Also, as shown in FIGS. 1-3 and 5, the sealing element 108 may be disposed in a groove extending circumferentially around the annular portion 112.

Figure 4:
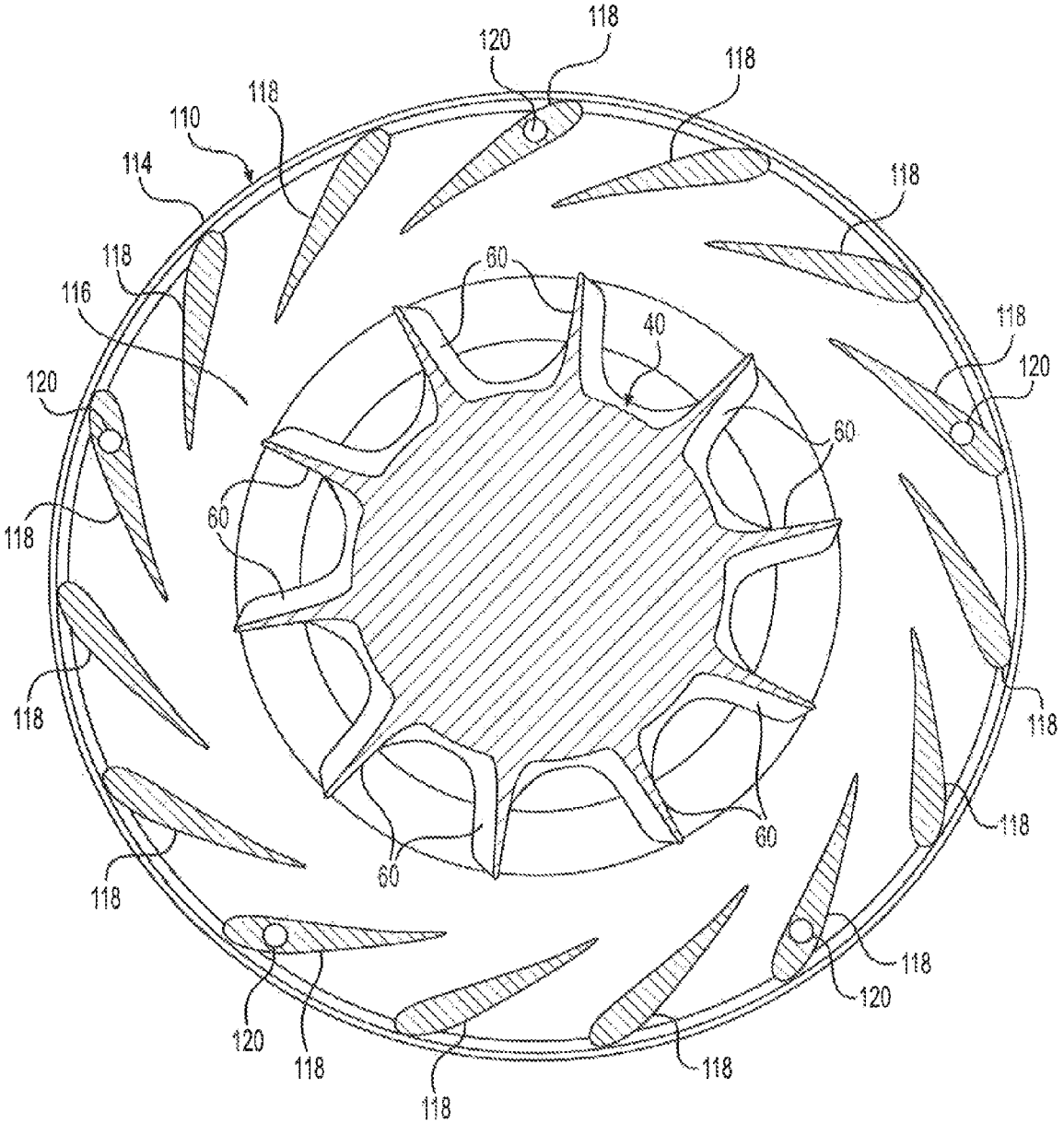
FIG. 4 is a rear view of a turbine shroud and a turbine wheel of the turbine assembly of FIG. 1.

FIG. 4 illustrates the turbine wheel 40 and the turbine shroud 110 of the turbocharger 10. The turbine shroud 110 may be symmetric with respect to its axis, which may be collinear with the rotational axis 42 of the turbine wheel 40. In addition to the annular portion 112, the turbine shroud 110 may include a nozzle portion 114 configured to receive the flow of exhaust from the turbine inlet 82 (e.g., from the channel 88 in the turbine housing 80) and direct the flow of exhaust to the turbine wheel 40. The turbine shroud 110 (e.g., including the annular portion 112 and the nozzle portion 114) may be formed integrally as a single-piece component.

The nozzle portion 114 may include a plate portion 116 connected to an end of the annular portion 112. The plate portion 116 may extend generally in the radial direction and may be generally ring-like, as shown in FIG. 4. The nozzle portion 114 may also include a plurality of nozzle vanes 118 attached to the plate portion 116. The nozzle vanes 118 may be configured to receive the flow of exhaust from the turbine inlet 82 (e.g., from the channel 88 in the turbine housing 80) and direct the flow of exhaust to the turbine wheel 40. The turbine shroud 110 shown in FIG. 4 includes fifteen nozzle vanes 118, but it is understood that the turbine shroud 110 may include more than or fewer than fifteen nozzle vanes 118. Also, the turbine wheel 40 shown in FIG. 4 includes ten blades 60, but it is understood that the turbine wheel 40 may include more than or fewer than ten blades 60. The nozzle vanes 118 may be connected to the annular portion 112 via the plate portion 116.

As shown in FIGS. 2-4, at least one of the plurality of nozzle vanes 118 may include at least one mounting hole 120 for receiving at least one fastener 122 (e.g., mounting bolts) configured to attach the turbine shroud 110 to the heat shield 140. The turbine shroud 110 shown in FIG. 4 includes five nozzle vanes 118 that each include one mounting hole 120, but it is understood that the turbine shroud 110 may include more than or fewer than five nozzle vanes 118 with one or more mounting holes 120.

The channel 88 in the turbine housing 80 may fluidly connect the volute 86 in the turbine housing 80 to the nozzle vanes 118. As shown in FIGS. 1 and 2, at least a portion of each of the channel 88 and the volute 86 may align with a portion of the nozzle portion 114 (e.g., the nozzle vanes 118) along the radial direction. Also, at least a portion of the nozzle portion 114 (e.g., the nozzle vanes 118) may align with at least a portion of the blades 60 of the turbine wheel 40 (e.g., the portion of the blades 60 including the leading edges 62 of the blades 60) along the radial direction. The flow of exhaust may be directed from the volute 86, through the channel 88, past the nozzle vanes 118, and then past the leading edges 62 of the blades 60. Due to the shape of the volute 86 and the nozzle vanes 118, the flow of exhaust may also travel along a spiral-shaped path inside the turbine housing 80 toward the turbine wheel 40.

Alternatively, the nozzle portion 114 may be omitted from the turbine shroud 110. The turbine shroud 110 may include the plate portion 116 connected to a plurality of struts or spacer elements, rather than the nozzle vanes 118, and one or more of the struts or spacer elements may attach the plate portion 116 to the heat shield 140.

In an embodiment, the plate portion 116 may intersect the annular portion 112 to form a curved surface 124 facing inward towards the turbine wheel 40. The curved surface 124 may be convex such that the concave portion 72 of each of the blades 60 of the turbine wheel 40 may curve around the curved surface 124, as shown in FIG. 2. The first corner 68 (between the leading edge 62 and the tip portion 66) and/or the second corner 70 (between the trailing edge 64 and the tip portion 66) of each of the blades 60 may be disposed close to or adjacent the curved surface 124. The first corner 68 may be aligned with the curved surface 124 of the turbine shroud 110 along the radial and axial directions.

The inner surface of the turbine shroud 110 may create a relatively small gap or clearance (tip clearance) with the blades 60 of the turbine wheel 40. The gap may be defined at three or more points along each of the blades 60. For example, the curved surface 124 may include a first point 126 such that a first gap 128 is formed between the first corner 68 of the blades 60 and the first point 126. In an embodiment, the first point 126 may be the closest point on the turbine shroud 110 to the first corner 68. The curved surface 124 may also include a second point 130 such that a second gap 132 is formed between the intermediate point 74 of the tip portion 66 and the second point 130. In an embodiment, the intermediate point 74 may be located at the "knee" of the curve formed by the tip portion 66, e.g., where the slope of the tip portion 66 relative to the rotational axis 42 of the turbine wheel 40 increases from horizontal (e.g., parallel to the rotational axis 42). Alternatively, the intermediate point 74 may be the point on the tip portion 66 that is the midpoint between the first corner 68 and the second corner 70. The second point 130 may be the closest point on the turbine shroud 110 to the intermediate point 74. The second point 130 may be located at the "knee" of the curve formed by the turbine shroud 110, e.g., where the slope of the surface of the turbine shroud 110 relative to the rotational axis 42 of the turbine wheel 40 increases from horizontal (e.g., parallel to the rotational axis 42). The inner surface of the annular portion 112 may include a third point 134 such that a third gap 136 is formed between the second corner 70 of the blades 60 and the third point 134. In an embodiment, the third point 134 may be the closest point on the turbine shroud 110 to the second corner 70. For example, the first gap 128, the second gap 132, and/or the third gap 136 may be less than about 0.020 inches or less than about 0.025 inches during the operation of the turbine assembly 14.

As shown in FIG. 2, when the turbine shroud 110 is disposed in the turbine housing 80, at least a portion of the plate portion 116 is received in the first step 92 inside the turbine housing 80 and at least a portion of the annular portion 112 is received in the second step 94 inside the turbine housing 80. At least a portion of the first inner annular surface 96 is aligned with at least a portion of the plate portion 116 along the radial direction, and at least a portion of the first inner radial surface 98 is aligned with the at least a portion of the plate portion 116 along the axial direction. Also, at least a portion of the second inner annular surface 100 is aligned with at least a portion of the annular portion 112 along the radial direction, and at least a portion of the second inner radial surface 102 is aligned with at least a portion of the annular portion 112 along the axial direction.

Figure 5:
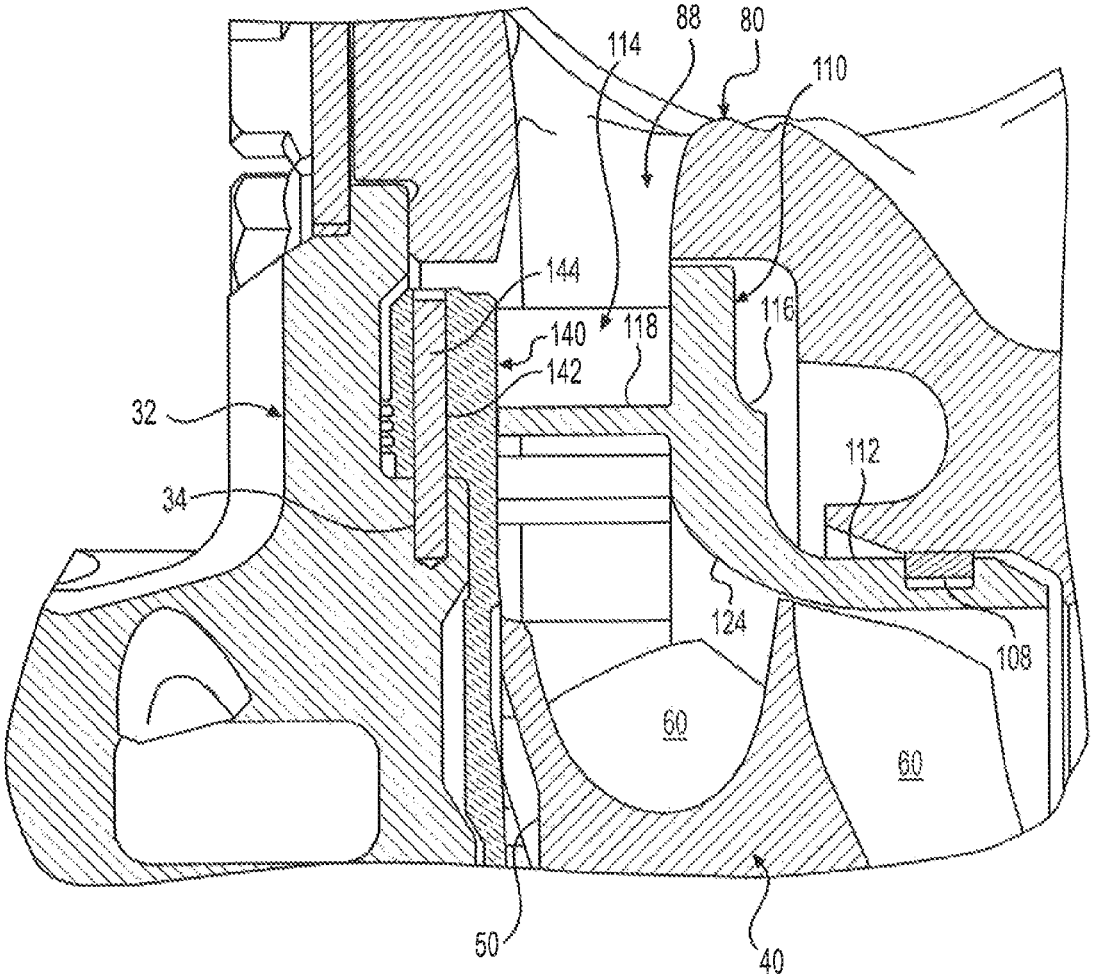
FIG. 5 is a cross-sectional view of another portion of the turbine assembly of FIG. 1.

FIG. 5 illustrates a portion of the turbocharger 10 including the bearing housing 32, the turbine wheel 40, the turbine housing 80, the turbine shroud 110, and the heat shield 140. The heat shield 140 may be disposed adjacent or near the second end 46 of the turbine wheel 40, and the turbine shroud 110 may be attached to the heat shield 140 by the fasteners 122, as shown in FIGS. 1-3. The heat shield 140 may be generally ring-like and may extend generally in the radial direction. In an embodiment, a majority of the back wall 50 of the turbine wheel 40 may face the heat shield 140. The heat shield 140 may be disposed between the bearing housing 32 and the turbine wheel 40 in the axial direction. The heat shield 140 may include a central opening, e.g., to allow the shaft 16 to pass through the heat shield 140 for connection to the turbine wheel 40.

In the embodiment shown in FIG. 5, the heat shield 140 may include a plurality of radial bores 142 that extend in the radial direction around the heat shield 140, e.g., around a circumferential surface of the heat shield 140. The bores 142 may align with a plurality of radial bores 34 in the bearing housing 32 that also extend along the radial direction. A plurality of pins 144 may be inserted into the pairs of aligned bores 34 and 142 to radially attach the heat shield 140 to the bearing housing 32 while allowing radial movement between the heat shield 140 and the bearing housing 32. In an embodiment, the bores 34 and 142 may be dimensioned so that the pins 144 are press fit into the respective bores 142 in the heat shield 140 and slidably received in the respective bores 34 in the bearing housing 32.

In the embodiment shown in FIGS. 1-5, the turbine shroud 110 may not be attached directly to the turbine housing 80. For example, the turbine shroud 110 may be fixedly attached to the heat shield 140 by the fasteners 122, the heat shield 140 may be radially attached to the bearing housing 32, and the turbine housing 80 may be rotatably attached to the bearing housing 32. Thus, the turbine shroud 110 may be attached to the turbine housing 80 indirectly via the radial attachment of the heat shield 140 to the bearing housing 32 and the rotatable attachment of the turbine housing 80 to the bearing housing 32. The sealing element 108 disposed on the turbine shroud 110 may contact the turbine housing 80 when the turbine shroud 110 is disposed in the turbine housing 80, but the sealing element 108 may not be attached directly to the turbine housing 80.

INDUSTRIAL APPLICABILITY

The disclosed turbine assembly and turbocharger find potential application in relation to any turbocharger. The disclosed turbine assembly and turbocharger find particular applicability in relation to a turbocharger associated with an internal combustion engine. One skilled in the art will recognize, however, that the disclosed turbine assembly and turbocharger could be utilized in relation to other systems that may or may not be associated with a turbocharger associated with an internal combustion engine.

Several advantages over the prior art may be associated with the turbine assembly and turbocharger described above. For example, the turbine shroud 110 may be formed separate from the turbine housing 80. Also, the turbine shroud 110 may have less mass and/or may be formed of thinner walls than the turbine housing 80. As a result, during operation of the turbocharger 10 (e.g., when hot exhaust gases are flowing from the turbine housing 80 through the turbine shroud 110 and around the turbine wheel 40), there may be less thermal mismatch between the turbine shroud 110 and the turbine wheel 40. The turbine shroud 110 may increase in temperature and expand at a rate that may be closer to the temperature increase and rate of expansion of the turbine wheel 40 (e.g., relative to the temperature increase and rate of expansion of the turbine housing 80). The turbine shroud 110 may not experience as much thermal lag as may be experienced by the turbine housing 80. With less thermal mismatch or lag, it may be possible to reduce the tip clearance between the blades 60 of the turbine wheel 40 and the inner surface of the turbine shroud 110, which may result in better efficiency of the turbocharger 10. Also, the turbine shroud 110 may be generally symmetric, which may also reduce the variation in tip clearance around the turbine wheel 40. This may also allow the tip clearance to be reduced and may improve the performance of the turbocharger 10.

Figure 6:
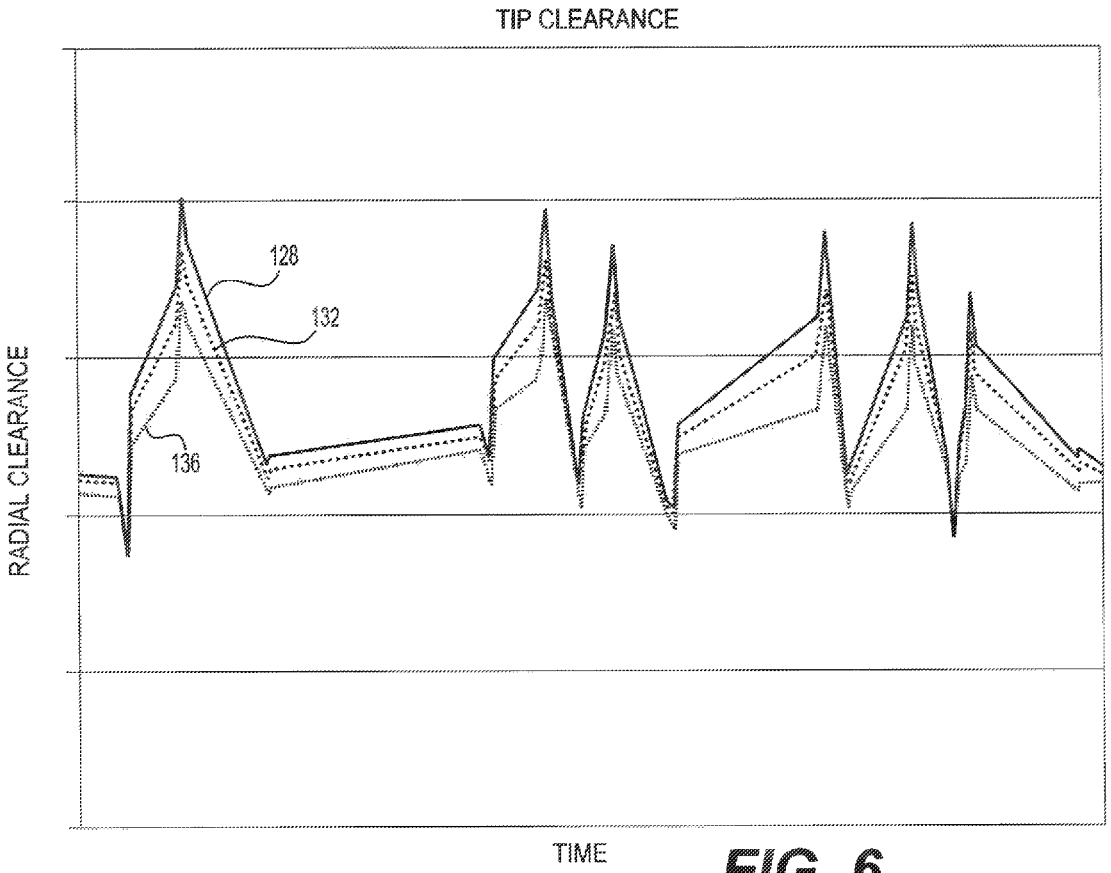
FIG. 6 is a graph of tip clearances at multiple points on a turbine wheel during operation of the turbocharger of FIG. 1.

FIG. 6 illustrates graphs of tip clearances at multiple points on the turbine wheel 40 during operation of the turbocharger 10, according to an embodiment. The tip clearances may be measured over time, and during this time period, the temperature of the flow of exhaust may vary between about 200 degrees Celsius to about 700 degrees Celsius at the turbine inlet 82. The solid line represents the first gap 128 between the first corner 68 of the blades 60 and the first point 126 on the turbine shroud 110, as shown in FIG. 2. The dashed line represents the second gap 132 between the intermediate point 74 of the tip portion 66 of the blades 60 and the second point 130 on the turbine shroud 110, as shown in FIG. 2. The dotted line represents the third gap 136 between the second corner 70 of the blades 60 and the third point 134 on the turbine shroud 110, as shown in FIG. 2. In these three examples, the tip clearances, e.g., the first gap 128, the second gap 132, and/or the third gap 136, may be generally close to each other in magnitude and may be less than about 0.025 inches during the operation of the turbine assembly 14. Thus, the turbine assembly 14 and turbocharger 10 described above may be able to maintain a relatively small tip clearance throughout the gap between the turbine wheel 40 and the turbine shroud 110, while the temperature of the flow exhaust varies.

In addition, the heat shield 140 may increase in temperature to a higher temperature (e.g., about 700 degrees Celsius) while the bearing housing 32 may remain at a lower temperature (e.g., about 400 degrees Celsius). The temperature differential may cause the heat shield 140 to expand more than the bearing housing 32. The pins 144 radially attaching the heat shield 140 to the bearing housing 32 may allow the heat shield 140 to expand while remaining generally concentric with the bearing housing 32. As a result, the turbine shroud 110, which is attached to the heat shield 140 by the fasteners 122, may remain generally concentric to the bearing housing 32 and the turbine wheel 40. Therefore, there may be less variation in tip clearance around the turbine wheel 40, which may also allow the tip clearance to be reduced and may improve the performance of the turbocharger 10.

The turbine shroud 110 may also be disposed in the turbine housing 80 so that the turbine shroud 110 may expand radially outward away from the turbine wheel 40, which may reduce the likelihood that the turbine wheel 40 may contact the turbine shroud 110 during operation of the turbocharger 10.

Further, rotation of the turbine housing 80 relative to the bearing housing 32, or "clocking" of the turbocharger 10, may be desired to orient the turbine housing 80 relative to the bearing housing 32. The turbine housing 80 may be attached to the bearing housing 32 to allow rotation of the turbine housing 80 around the rotational axis 42 of the turbine wheel 40 relative to the bearing housing 32. The heat shield 140 may be radially attached to the bearing housing 32, and the turbine shroud 110 may be fastened to the heat shield 140 by the fasteners 122. Therefore, the turbine housing 80 may also be rotatable with respect to the heat shield 140 and the turbine shroud 110. Further, the weight of the turbine housing 80 may be isolated from the turbine shroud 110 and may not affect the tip clearance or the centering of the turbine shroud 110.

In addition, the turbine wheel 40 may be a mixed-flow turbine wheel, e.g., the leading edge 62 may be angled with respect to the rotational axis 42. As a result, the turbocharger 10 may provide better efficiency in certain applications.

It will be apparent to those skilled in the art that various modifications and variations can be made to the disclosed turbine assembly and turbocharger. Other embodiments will be apparent to those skilled in the art from consideration of the specification and practice of the disclosed turbine assembly and turbocharger. It is intended that the specification and examples be considered as exemplary only, with a true scope being indicated by the following claims and their equivalents.

We claim:

1. A turbine assembly comprising:

a turbine housing;

a turbine wheel disposed within the turbine housing, the turbine wheel including a first end opposite a second end and a rotational axis extending between the first end and the second end, the turbine wheel including a plurality of blades;

a turbine shroud disposed between the turbine housing and the turbine wheel along a radial direction, the turbine shroud being separate from the turbine housing, the turbine shroud including:

an annular portion extending generally in an axial direction with respect to the rotational axis, at least a portion of the plurality of blades being disposed in at least a portion of the annular portion, and a plate portion intersecting the annular portion to form a convex curved surface;

wherein each of the plurality of blades of the turbine wheel includes a leading edge and a tip portion, each leading edge being angled with respect to the rotational axis, each tip portion forming a concave portion that curves around the curved surface of the turbine shroud; and a heat shield disposed adjacent the second end of the turbine wheel, the turbine shroud being attached to the heat shield, wherein the heat shield further includes a plurality of bores extending along the radial direction for receiving a plurality of pins configured to radially attach the heat shield to a bearing housing, wherein the plurality of pins are press fit into respective bores in the heat shield and slidably received in respective bores in the bearing housing.

2. The turbine assembly of claim 1, wherein a gap is formed between at least a portion of the turbine shroud and the turbine housing.

3. The turbine assembly of claim 1, wherein the turbine shroud is symmetric with respect to the rotational axis, and the turbine housing is asymmetric with respect to the rotational axis.

4. The turbine assembly of claim 1, wherein each of the plurality of blades has a leading edge that forms an angle of about 10 to about 40 degrees with respect to the rotational axis.

5. The turbine assembly of claim 1, wherein the leading edge and the tip portion of each of the plurality of blades intersect to form a first corner.

6. The turbine assembly of claim 5, wherein the curved surface of the turbine shroud is disposed adjacent the first corner of each of the plurality of blades such that each first corner is aligned with the curved surface of the turbine shroud along the radial direction and along the axial direction.

7. The turbine assembly of claim 1, wherein a gap between a first point on the curved surface and the first corner is less than about 0.025 inches during operation of the turbine assembly.

8. The turbine assembly of claim 1, wherein:

the concave portion is located between an intermediate point on the tip portion and the first corner; and a gap between a second point on the curved surface of the turbine shroud and the intermediate point on the tip portion is less than about 0.025 inches during the operation of the turbine assembly.

9. The turbine assembly of claim 1, wherein:

each of the plurality of blades have a trailing edge intersecting the tip portion to form a second corner; and a gap between the second corner and a point on the annular portion of the turbine shroud is less than about 0.025 inches during the operation of the turbine assembly.

10. The turbine assembly of claim 1, wherein the turbine shroud further includes a nozzle portion, the nozzle portion including the plate portion and a plurality of nozzle vanes attached to the plate portion, the plurality of nozzle vanes being configured to receive a flow of exhaust from a turbine inlet in the turbine housing.

11. The turbine assembly of claim 1, further including a sealing element disposed around the annular portion and configured to limit a flow of exhaust between the turbine housing and the turbine shroud.

12. A turbocharger comprising:

a compressor housing including a compressor wheel;

a turbine housing including a turbine wheel, the turbine wheel including a first end opposite a second end and a rotational axis extending between the first end and the second end;

a shaft attached at a first end to the compressor wheel and attached at a second end to the turbine wheel;

a bearing housing connecting the compressor housing to the turbine housing;

a turbine shroud disposed between the turbine housing and the turbine wheel along a radial direction, the turbine shroud being separate from the turbine housing; and a heat shield radially attached to the bearing housing by a plurality of pins extending along the radial direction, the heat shield being disposed between the bearing housing and the turbine wheel, wherein the plurality of pins are press fit into respective bores in the heat shield and slidably received in respective bores in the bearing housing.

13. The turbocharger of claim 12, wherein the turbine housing is rotatable around the rotational axis relative to the heat shield and the turbine shroud.

14. The turbocharger of claim 12, wherein the turbine shroud is attached to the heat shield by a plurality of fasteners.

* * * * *